US005853001A

United States Patent [19]

Vyprachticky

[11] Patent Number: 5,853,001

[45] Date of Patent: Dec. 29, 1998

[54] ARCHERY BOW HANDGRIP

[76] Inventor: Emil Vyprachticky, 7713 Webster Way, Arvada, Colo. 80003

[21] Appl. No.: 839,210

[22] Filed: Apr. 22, 1997

[51] Int. Cl.[6] ..... F41B 5/00

[52] U.S. Cl. ..... 124/88

[58] Field of Search ..... 124/23.1, 86, 88

[56] References Cited

U.S. PATENT DOCUMENTS

| | | | |
|---|---|---|---|
| 3,599,621 | 8/1971 | Scrobell | 124/23.1 |
| 4,343,286 | 8/1982 | Thacker | 124/88 X |
| 4,457,287 | 7/1984 | Babington | 124/88 X |
| 5,349,937 | 9/1994 | Burling | 124/86 X |
| 5,400,764 | 3/1995 | Spolar et al. | 124/88 |
| 5,469,834 | 11/1995 | Higgins et al. | 124/88 |
| 5,651,354 | 7/1997 | LaHaise | 124/23.1 |

*Primary Examiner*—John A. Ricci
*Attorney, Agent, or Firm*—Richard W. Hanes

[57] ABSTRACT

An archery bow comprises a riser with upper and lower flexible limbs and a bow string defining a bow plane. A hand grip is provided, which may project laterally from the bow plane. A beam member interconnects the riser and hand grip. The beam member is adjustable fore and aft with respect to the riser and may be fixed in position with fasteners. The hand grip may be hingedly connected to the beam member. This arrangement allows the archer to adjust the position of the nocking point on the bow string when the bow is fully drawn.

14 Claims, 2 Drawing Sheets

ARCHERY BOW HANDGRIP

The present invention relates to an adjustable handgrip for an archery bow.

BACKGROUND OF THE INVENTION

Handgrips on archery bows are traditionally integral with the central part of the bow. In bows having limbs attached to a central base, or frame, that central portion is often referred to as the riser. Separate handgrips, detached from the main bow structure, or the riser, are shown in U.S. Pat. Nos. 218,079 and 213,851 to Streeter, 3,599,621 to Scrobell, 3,834,368 to Geiger, 3,182,651 to Huntley, 3,517,658 to Shurts and 4,124,014 to Darlington.

More recently, on Nov. 29, 1988, U.S. Letters Patent, No. 4,787,361, ("'361") issued to the present inventor, for Archery Bow With Self-Aligning Combination Handgrip And Forearm Protector. The '361 patent discloses a separate handgrip and inside forearm protector that is secured by a hinge to the mid portion of the riser of an archery bow. A pivotal hinge connection between the handgrip and the bow riser prevents torque from being transferred to the bow, by the hand holding it, in a direction that would twist the bow about its longitudinal axis. Further, by permitting the angle between the protruding forearm protector and the plane of the bow axis to freely change, the pivotal connection accommodates any thickness of clothing worn on the arm of the shooter.

In U.S. Pat. No. 4,124,014 Darlington recognized an advantage in providing a separate handgrip for a compound type bow which would be adjustable fore, aft and laterally with respect to the bow. Darlington's fore and aft position adjustment of the handgrip is said to be for permitting variation of the bow's draw length. The object of the lateral adjustment feature is to obtain balance and stabilization.

Compound bows involve the use of wheels, cams and eccentrically mounted pulleys to achieve power and to provide a release of the drawing force after the draw has reached a certain point. Especially with a compound bow of the type described in the present inventor's co-pending patent application, Ser. No. 08/630,902, filed Apr. 4, 1996, for COMPOUND ARCHERY BOW WITH BILATERAL CABLE CAMS, Now U.S. Pat. No. 5,687,703, the cams and pulleys may be interchanged or substituted in order to modify the characteristics of the bow. When so modified, or even initially, before modification, the archer may be dissatisfied with the position of the nocking point, vis-à vis the archer's chin, or some other anatomical reference point, at the full draw of the bowstring.

OBJECTS OF THE INVENTION

It is therefore the primary object of the present invention to provide, for a compound archery bow, a pivotally mounted, laterally extending handgrip with fore and aft adjustment capabilities, in order to render, for a particular archer, the desired position of the nocking point at full bowstring draw, while maintaining the advantages of the pivotal connection between the handgrip and the bow.

DETAILED DESCRIPTION

Figure 1:
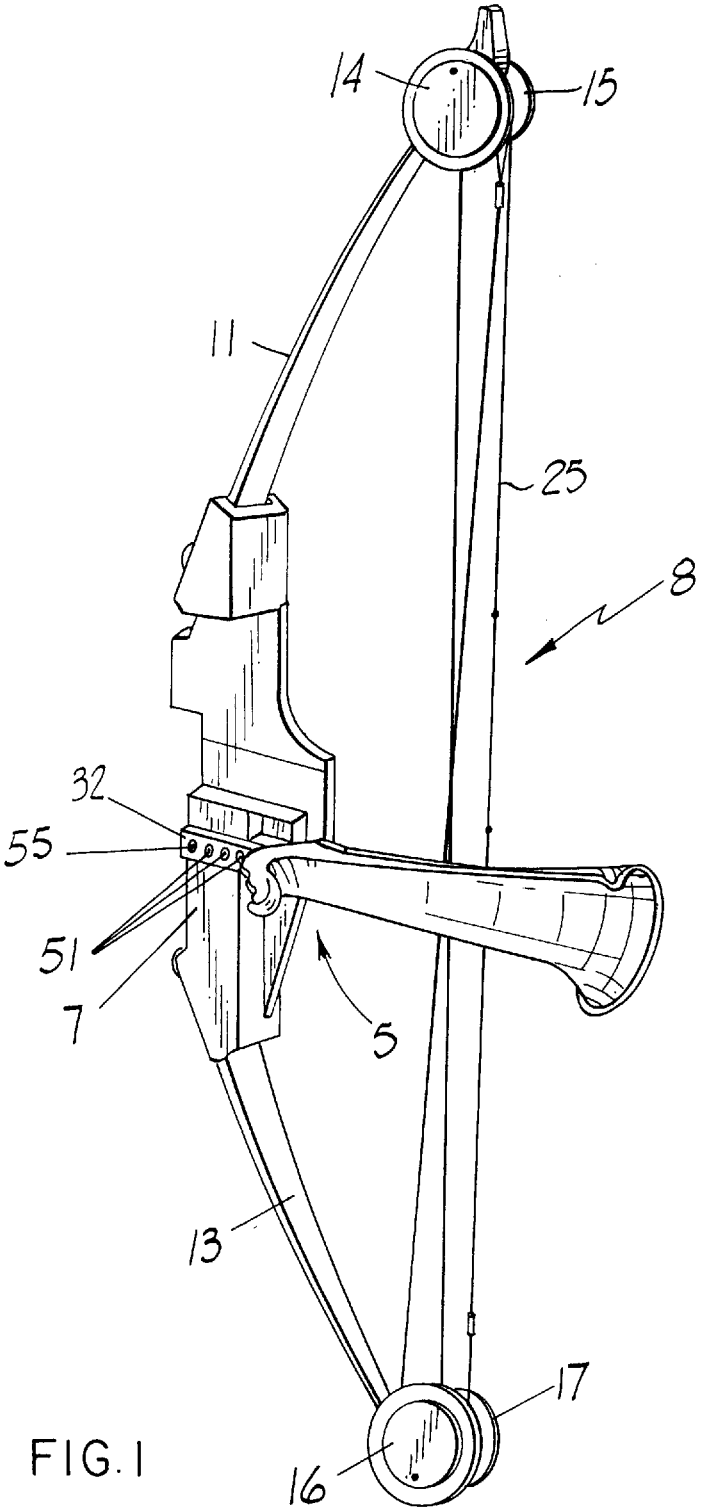
FIG. 1 is a perspective view of a compound bow having the fore and aft adjustable handgrip of the present invention.
Figure 3:
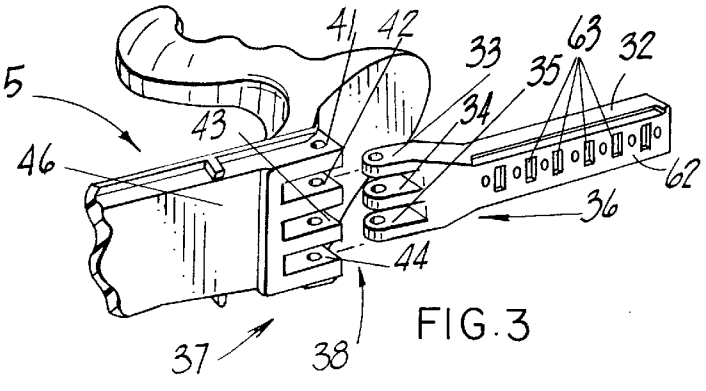
FIG. 3 is an enlarged fragmentary perspective view of the handgrip and associated arm guard with the fore and aft adjustable hinging beam shown separated from the hinge leaf which is integral with the handgrip and arm guard.
Figure 2:
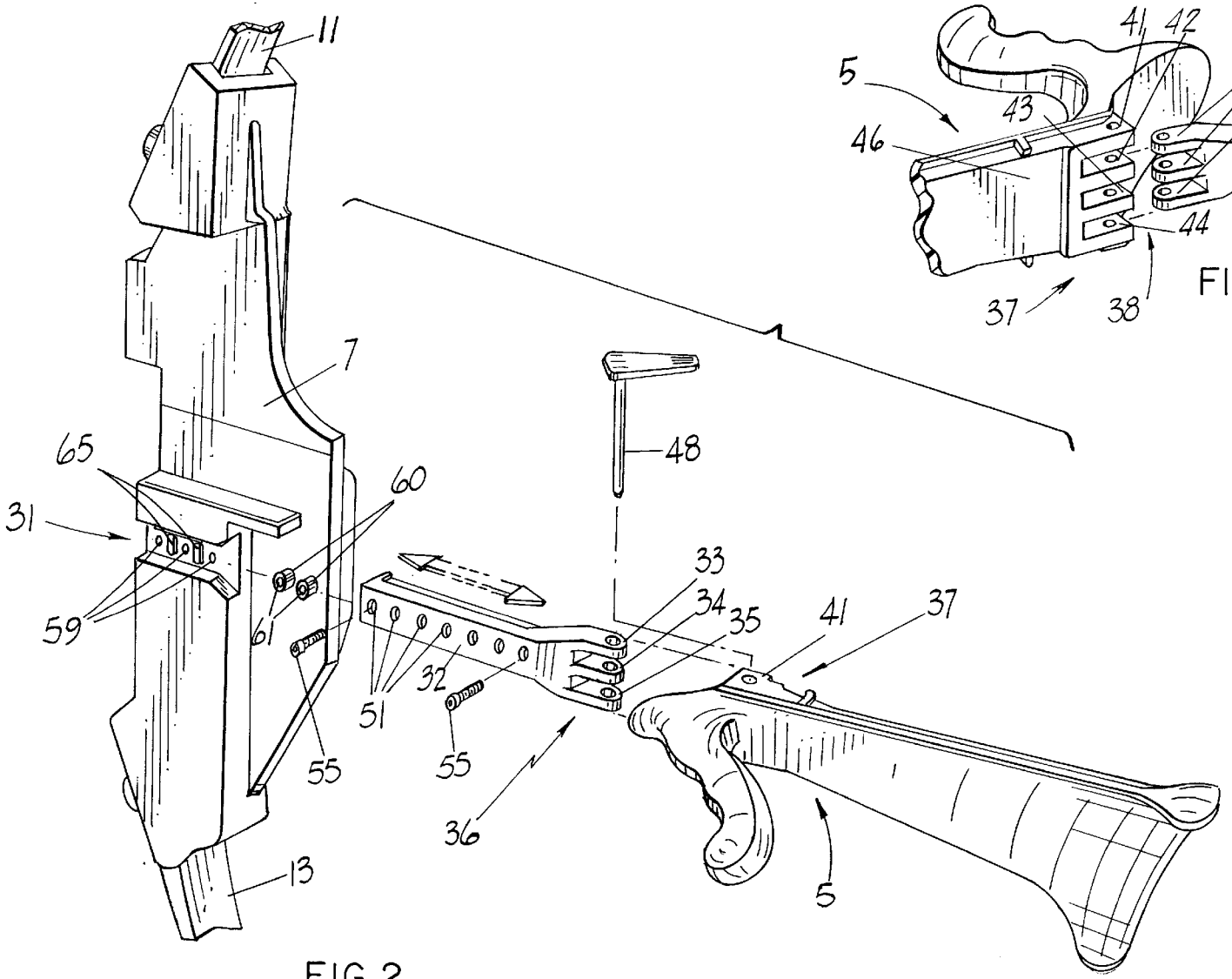
FIG. 2 is an enlarged exploded perspective view of the compound bow riser and the hinging beam that interconnects the riser with the handgrip.

The preferred form of the handgrip and associated forearm guard 5 is described in detail in the aforementioned U.S. Pat. No. 4,787,363, to which reference is hereby made for a full description. Referring first to FIGS. 1 and 2 of the drawings, the riser 7 of a compound archery bow 8 supports upper and lower flexible limbs 11 and 13. The limbs and the riser define a common plane, which will be referred to as the bow plane. Eccentrically mounted rotatable cams 14, 15, 16 and 17 are carried at the distal ends of the limbs. A bowstring 25 is attached to cams 14 and 16. The exact construction of the bow and the cams, cables and bowstring is detailed in the aforementioned U.S. Pat. No. 5,687,703, to which reference is hereby made.

A thickened lower portion of the riser 7 contains a rectangular slot 31 into which is placed a rectangular rigid beam member 32. The rearward facing end of the beam member is formed with three parallel and spaced apart fingers 33, 34 and 35, together comprising the second leaf 36 of a double leaf hinge 38. Fingers 41, 42, 43 and 44, comprising the first leaf 37 of the double leaf hinge 38, may be attached to or integrally molded with the inside portion 46 of the handgrip 5. When assembled, the first and second leaves are interleaved and connected with a hinge pin 48. The interconnection of the first and second leaves 36 and 37 of the double leaf hinge 38 is made in the traditional manner of a hinge, with the pin 48 passing through aligned holes in the ends of the leaves' fingers.

The beam member 32 contains a plurality of parallel bores 51 through the beam. When the beam member is properly positioned in the slot 31 the bores 51 are each aligned so that they are perpendicular to the bow plane. The bores 51 are each adapted to receive a threaded fastener 55 that passes through the width of the beam member and into a corresponding receiving hole 59 in the riser. Two of the bores 51 will match two of the receiving holes 59, allowing the beam member to be selectively positioned in the slot 31 so that the second leaf hinge can assume a plurality of different positions, fore or aft of a specified reference point on the riser 7. For additional means to secure the beam member 32, when it is selected for an extreme aft position, bosses 60 are raised to the level of the slot 31 from the lateral side surface of the riser 7. Receiving holes 61 in the bosses act in the same manner as the receiving holes 59 at the bottom of the slot 31, to receive and hold the fasteners 55.

To enhance the ease of matching a pair of bores 51 to two selected holes 59 or 61, the flat inside surface 62 of the beam member 32 is fitted with a plurality of spaced apart indexing detents 63. These detents are adapted to fit snugly around similarly spaced apart and correspondingly shaped raised keys 65 in the bottom of the slot 31. In addition to their indexing function, the cooperating keys and detents resist the force applied to the connection between the handgrip and the bow riser, thus reducing the stress on the fasteners 55.

In operation, if the position of the nocking point is unsatisfactory to the archer, the fore and aft position of the handgrip 5 may be adjusted by removing the fasteners 55 and relocating the beam member on the riser. Once relocated, the fasteners are replaced in a pair of bores that align with either or both of the holes 59 or 61. For example, if the hinging beam 32 is fixed into its most rearward position, the riser of the bow will be at its most forward possible position with respect to the body of the archer, and the nocking point will be located at or beyond the archer's chin. On the other hand, if the hinging beam 32 is fixed into its most forward possible position, the riser of the bow will be at its most rearward position with respect to the body of the archer. At such position, the nocking point, at full draw, will be located in the vicinity of the archer's ear. Obviously, any point in between the extreme forward and the extreme rearward positions of the hinging beam 32 may be selected in order to position the nocking point, at full draw, at some point between the archer's ear and a position forward of the chin.

I claim:

1. In an archery bow having, a riser, a pair of flexible limbs attached to the riser, defining, with the riser, a bow plane, and a handgrip laterally projecting from the bow plane, the improvement comprising, attachment means pivotally interconnecting the handgrip and the riser, including, a hinge joint having first and second leaves, where the first leaf is carried by the handgrip, and a beam member carrying the second leaf of the hinge joint and having means for selectively locating the beam member fore and aft with respect to the riser.

2. The combination of claim 1, where the hinge joint comprises a double leaf hinge and where the first one of said leaves is attached to the handgrip and the second of said leaves is attached to the beam member.

3. The combination of claim 2, where the beam member includes an elongated unitary extension of the second of said hinge leaves.

4. The combination of claim 3, and further including a plurality of apertures in the beam, each being aligned perpendicularly to the bow plane.

5. The combination of claim 4 where the handgrip includes rearward projecting cuff means to partially cover and contact the inside forearm of an archer.

6. In an archery bow having, a riser, a pair of flexible limbs attached to the riser, defining, with the riser, a bow plane, and a handgrip laterally projecting from the bow plane, a double leaf hinge having first and second leaves, where the first leaf is attached to the handgrip, and a beam member carried by the second leaf of the hinge and including means for selectively positioning the beam member fore and aft of the riser.

7. The combination of claim 6, wherein the means for selectively positioning the beam member includes a plurality of apertures in the beam, each being aligned perpendicularly to the bow plane.

8. The combination of claim 7 wherein the handgrip includes rearward projecting cuff means to partially cover and contact the inside forearm of an archer.

9. The combination of claim 8 wherein the double leaf hinge includes a hinge pin that is disposed parallel to the bow plane and perpendicular to the longitudinal axis of the beam member.

10. In an archer's bow, the combination comprising, a riser, comprising the central part of an elongated flexible member, a handgrip spaced apart from said riser, a beam member interconnecting the riser and the handgrip, and means interconnecting the riser and the beam member for selectively positioning the beam member fore and aft with respect to the riser.

11. The combination of claim 10 where the handgrip projects laterally from a plane containing the elongated flexible member.

12. The combination of claim 11 and further including a pivotal interconnection between the beam member and the handgrip.

13. The combination of claim 12 where the pivotal interconnection includes an axis of rotation that is substantially parallel to the plane containing the elongated flexible member.

14. The combination of claim 13 where the pivotal interconnection comprises a hinge.

* * * * *